United States Patent [19]

Sweeney

[11] 4,395,267

[45] Jul. 26, 1983

[54] NOVEL METHOD OF EXTENDING A HYDROCARBON FUEL HEAVIER THAN GASOLINE

[75] Inventor: William M. Sweeney, Wappingers Falls, N.Y.

[73] Assignee: Texaco, Inc., White Plains, N.Y.

[21] Appl. No.: 134,036

[22] Filed: Mar. 26, 1980

[51] Int. Cl.[3] ..... C10L 1/18

[52] U.S. Cl. ..... 44/56; 44/57; 44/77

[58] Field of Search ..... 44/56, 77, 57

[56] References Cited

U.S. PATENT DOCUMENTS

| | | | |
|---|---|---|---|
| 2,827,494 | 3/1958 | Brown, Jr. et al. | 44/77 |
| 2,878,109 | 3/1959 | Wood et al. | 44/77 |
| 3,869,262 | 3/1975 | Mayerhoffer et al. | 44/77 |

*Primary Examiner*—Jacqueline V. Howard

*Attorney, Agent, or Firm*—Carl G. Ries; Robert A. Kulason; Carl G. Seutter

[57] ABSTRACT

Hydrocarbon fuels heavier than gasoline may be extended by addition thereto of immiscible alcohols in the presence of an acetal or ketal or orthoester co-solvent.

2 Claims, No Drawings

NOVEL METHOD OF EXTENDING A HYDROCARBON FUEL HEAVIER THAN GASOLINE

FIELD OF THE INVENTION

This invention relates to a novel method of extending liquid hydrocarbon fuels heavier than gasoline. More particularly it relates to the extension of a furnace oil with methanol or ethanol in the presence of a ketal or acetal or orthoester as a cosolvent.

BACKGROUND OF THE INVENTION

As is well known to those skilled in the art, hydrocarbon fuels heavier than gasoline, including middle distillate hydrocarbon fuels typified by furnace oils or fuel oils may become in short supply as refiners attempt to obtain higher percentages of gasoline from crude oils. Attempts to extend these fuels by addition thereto of alcohols such as methanol or ethanol, for example, have not heretofore been satisfactory because these fuels (such as No. 2 furnace oil) will only dissolve eg methanol to the extent of a percent or two.

It is an object of this invention to provide a method of extending hydrocarbon fuels heavier than gasoline including middle distillate fuels. Other objects will be apparent to those skilled in the art.

STATEMENT OF THE INVENTION

In accordance with certain of its aspects, this invention is directed to a method of extending a hydrocarbon fuel heavier than gasoline which comprises mixing (i) a hydrocarbon fuel heavier than gasoline, (ii) a water-miscible alcohol which is substantially immiscible with said fuel, and (iii) a ketal or acetal or orthoester thereby forming a single phase extended hydrocarbon fuel heavier than gasoline; and recovering said single phase extended hydrocarbon fuel heavier than gasoline.

In accordance with certain of its other aspects, this invention is directed to a novel composition comprising a hydrocarbon fuel heavier than gasoline, a water-miscible alcohol which is substantially immiscible with said fuel, and a ketal or acetal or an orthoester as a cosolvent for said hydrocarbon fuel heavier than gasoline and said water-miscible alcohol.

DESCRIPTION OF THE INVENTION

The hydrocarbon fuels heavier than gasoline which may be extended by the process of this invention include those which typically have an initial boiling point (ibp) above about 320° F. Typically such fractions may be identified as kerosene, diesel oil or furnace oil, fuel oil, light gas oil, heavy gas oil, light cycle gas oil, heavy cycle gas oil, vacuum gas oil, etc. These fractions commonly have an initial boiling point above about 340° F. and may have end points as high as 1100° F. They typically have an API gravity below about 40.

In the case of a diesel oil or furnace oil, the fuel may be characterized by an ibp of 325° F.–425° F., an ep of 575° F.–690° F., say 610° F., and an API gravity of 25–50, say 40.

In the case of a vacuum gas oil, the fuel may be characterized by an ibp of 600° F.–700° F., say 650° F., an ep of 900° F.–1100° F., say 1050° F., and an API gravity of 10–35, say 25.

In the case of a typical residual fuel oil, it may be characterized by an API gravity of 5–25, say 20.

In the case of a light cycle gas oil, it may be characterized by an ibp of 300° F.–400° F., say 350° F., an ep of 575° F.–670° F., say 610° F., and an API gravity of 20–40, say 30.

In the case of a heavy cycle gas oil, it may be characterized by an ibp of 500° F.–550° F., say 525° F., an ep of 600° F.–700° F., say 680° F., and an API gravity of 20–35, say 25.

In the case of kerosene, it may be characterized by an ibp of 300° F.–400° F., say 350° F., an ep of 500° F.–600° F., say 550° F. and an API gravity of 30–70, say 50.

Illustrative fuels which may be treated by the process of this invention include (i) a No. 2 furnace oil having an ibp of 376° F., an ep of 623° F., an API gravity of 35, and a cetane number of 47.5; or (ii) a vacuum gas oil having an ibp of 680° F., and ep of 1050° F., and an API gravity of 25.

In practice of the process of this invention, such hydrocarbon fuels heavier than gasoline, including middle distillate hydrocarbon fuels may be extended by addition thereto of a water-miscible alcohol which is substantially immiscible with said fuel. The water-miscible (at room temperature) alcohols which may be used in practice of the process of this invention include those which, at ambient room temperature of ca 75° F. are soluble in the fuel oil in amount less than about 5 volumes per 100 volumes of fuel oil. When the hydrocarbon is dry, methanol is immiscible therein and ethanol and heavier alcohols are miscible therein; thus the process of the invention may be used in connection with methanol. When the hydrocarbon contains water in amount greater than about 0.1 w %, as is common, then methanol and ethanol are both immiscible in the hydrocarbons and the process of this invention may be found to be particularly advantageous. The preferred alcohol is methanol. Alcohols used may be anhydrous i.e. containing less than about 1 v % water; however the advantages of this invention may be most apparent when the alcohol is wet eg as in the case of 95 w % ethanol. Ethanol-rich or methanol-rich streams may be employed eg a stream containing 10 v % or less of other components together with 90 v % or more of ethanol.

It should be noted that in the case of kerosene as well as diesel oil or furnace oil, ethanol is soluble therein; and the technique of this invention may be useful in the case of methanol. If however these hydrocarbons contain as little as 0.2 v % water, both methanol and ethanol are immiscible and the technique of this invention may be useful.

The amount of alcohol which may be added in practice of the process of this invention is an extending amount typically 5–500 volumes, preferably 10–100 volumes, say about 31 volumes per 100 volumes of hydrocarbon. It is found that typically not all of the added alcohol is miscible with the hydrocarbon at ambient temperature. In the case of a No. 2 furnace oil, only about 1–2 volumes of methanol will dissolve at 70° F.; and the rest may be present as a separate phase. A 10 v % solution of ethanol which is miscible at room temperature will however separate if chilled.

There is also added to the composition at least one ketal, acetal, or orthoester, as a cosolvent. Mixtures of more than one of these may be employed.

The ketal may be characterized by the formula $R_2C(OR')_2$; the acetal may be characterized by the formula $RCH(OR')_2$; and the orthoester may be characterized by the formula $RC(OR')_3$.

In the above compound, R or R′ may be a hydrocarbon radical selected from the group consisting of alkyl and cycloalkyl including such radicals when inertly substituted. When R is alkyl, it may typically be methyl, ethyl, n-propyl, n-butyl, i-butyl, sec-buty, amyl, octyl, decyl, octadecyl, etc. When R is cycloalkyl, it may typically be cyclohexyl, cycloheptyl, cyclooctyl, 2-methylcycloheptyl, 3-butylcyclohexyl, 3-methylcyclohexyl, etc. R may be inertly substituted i.e. it may bear a non-reactive substituent such as alkyl, cycloalkyl, ether, halogen, etc. Typically inertly substituted R groups may include 3-chloropropyl, 2-ethoxyethyl, carboethoxymethyl, 4-methyl cyclohexyl, etc. The preferred R groups may be lower alkyl, i.e. $C_1$–$C_{10}$ alkyl, groups including eg methyl, ethyl, n-propyl, i-propyl, butyls, amyls, hexyls, octyls, decyls, etc. R may preferably by methyl and R′ may preferably be methyl or ethyl in the case of ketal.

In the preferred embodiment, R and R′ may be lower alkyl i.e. $C_1$ to $C_{10}$ but more preferably $C_1$ to $C_4$ alkyl. Illustrative ketals may include:

| TABLE |
|---|
| 2,2-dimethoxy propane |
| 2,2-dimethoxy pentane |
| 2,2-dimethoxy butane |
| 3,3-dimethoxy pentane |
| 2,2-diethoxy propane |
| 2,2-di(cyclohexoxy) propane, etc. |

Illustrative acetals may include:

| TABLE |
|---|
| di-methoxy methane |
| 1,1-di-methoxy propane |
| 1,1-diethoxy propane |
| 1,1-dipropoxy propane |
| 1,1-dimethoxy-n-butane |
| 1,1-diethoxy-n-butane |
| 1,1-dimethoxy ethane |
| 1,1-diethoxymethyl benzene etc. |

Illustrative orthoesters may include:

| TABLE |
|---|
| ethyl orthoformate |
| methyl orthobutyrate |
| n-propyl orthoacetate |

The ketal, acetal, or orthoester cosolvent may typically be added in cosolvent amount of 10–1000 volumes, preferably 10–100 volumes, say about 55 volumes per 100 volumes of hydrocarbon fuel. Preferably the cosolvent will be present in amount in excess of the amount of alcohol.

An illustrative composition may thus include:

| | |
|---|---|
| 100 volumes | No. 2 furnace oil |
| 31.2 volumes | methanol |
| 56.5 volumes | 2,2-dimethoxy propane |

Another illustrative composition may include:

| | |
|---|---|
| 100 volumes | vacuum gas oil |
| 50 volumes | methanol |
| 85 volumes | 2,2-dimethoxy propane |

It is a feature of these compositions that as prepared, they are single-phase compositions of improved stability over extended periods of time. In the presence of small amounts of water (eg up to about one volume per 100 volumes of hydrocarbon) contacted over an extended period of time, the dry compositions may retain their single phase integrity. Absent ketal or acetal or orthoester cosolvent, in the presence of water in amount above about one part per 100 parts of hydrocarbon, the moist or wet hydrocarbon-alcohol composition would form two phases: (i) a hydrocarbon phase and (ii) an alcohol phase.

It is found that water stability of the hydrocarbon-alcohol-acetal or ketal or orthoester composition may be achieved in the presence of acid. The acid which catalyses the reaction of water with ketal or acetal or orthoester may be present in the various containers or conduits through which the composition passes or it may be present in water which is absorbed in the mixture as it stands or alternatively the mixtures may be contacted with acid. The dry composition may retain its integrity with respect to maintenance of a single phase in the presence of water in amount up to about one part of water per 100 parts of hydrocarbon at 20° C.; but if the solubility limit of the water is exceeded, then it may be desirable to accelerate the reaction of water with acetal or ketal or orthoester by addition of acid in order to permit formation of a single phase from the wet hydrocarbon system.

It may be possible to add sufficient acid (a catalytic amount) to the composition to maintain the pH below 7 eg at 1–6.5 in the aqueous phase. This may be effected by use of strong solid or liquid acids. When the water absorbed is of sufficiently low pH, it may not be necessary to add additional acid. When the acid is a liquid, it may be an inorganic acid such as sulfuric acid, nitric acid, etc. or an organic acid such as p-toluene sulfonic acid, etc.

It is possible to employ solid acids including resins such as reticular sulfonated styrenedivinyl benzene copolymer cation exchange resins typified by the Rohm and Haas Amberlyst 15, having a hydrogen ion concentration of 4.9 meq per gram of dry resin and a surface area of 42.5 square meters per gram.

The preferred acid is added to the composition in catalytic amount. In the case of the solid zeolite or resin acids, it may be desirable to suspend bags or baskets of acid pellets in contact with the composition.

The stabilized compositions may be found to be stable over an extended period of time and, when they contain adequate proportions of ketal or acetal or orthoester, may be stable in the presence of unexpectedly high proportions of water, especially so at a pH below 7.

It appears that the ketal, or orthoester, or acetal may be dual function additives: (i) they may serve as cosolvents to increase the miscibility of the hydrocarbon and the alcohol and (ii) they may under acid conditions, react with water which is present and thereby inhibit formation of two phases which would otherwise form in the presence of substantial quantities of water. The ketal, acetal, or orthoester may function by reacting with the water thereby forming alcohols. Water is thus removed from the system and alcohol substituted therefor.

In the case of diesel fuel compositions, typified by one containing 100 volumes of diesel oil, 50 volumes of absolute ethanol, and 16.7 volumes of 2,2-dimethoxy propane, it may be found that the cetane number is undesirably low eg ca 30; and in order to increase this to desired level of eg 40, it may be desirable to add a diesel ignition improver typified by an alkyl (preferably lower alkyl $C_1$–$C_8$) nitrate such as hexyl nitrate or octyl nitrate or amyl nitrate.

Practice of the process of this invention may be apparent to those skilled in the art from the Example which follow.

DESCRIPTION OF PREFERRED EMBODIMENTS

Example I

A mixture is formed containing 100 volumes of No. 2 furnace oil and 31.2 volumes of methanol; and this mixture is found to possess two phases: (i) a hydrocarbon phase and (ii) an alcohol phase. The solubility at 20° C. of methanol in No. 2 furnace oil is about 1.5 w %.

To the two phase mixture, there is added with stirring, 56.5 volumes of 2,2-dimethoxy propane; and the resulting composition is found to be a single phase composition.

Example II

In this Example, there are mixed (i) 100 volumes of vacuum gas oil, (ii) 50 volumes methanol, and (iii) 85 volumes of 2,2-dimethoxy propane. The resulting composition is found to be a single phase composition.

Example III

In this Example, 21 volumes of absolute methanol and 80 volumes of kerosene are shaken with 0.8 volumes of water to yield a two phase mixture. 9 volumes of 2,2-dimethoxy propane and 0.5 volumes of p-toluene sulfonic acid are added with agitation, and the two phases coalesce into one phase.

Example IV

In this Example, 100 volumes of vacuum gas oil (as in Example II) and 50 volumes of methanol are mixed to form a two-phase mixture. One volume of water is added; the mixture still retains two phases.

There is then added with agitation 85 volumes of 2,2-dimethoxy propane and one drop (ca 0.5 v) of concentrated sulfuric acid. The mixture becomes a single phase mixture.

Results comparable to Example I may be attained if the additive, instead of 2,2-dimethoxy propane, is:

TABLE

| EXAMPLE | ADDITIVE |
|---|---|
| V | 2,2-diethoxy propane |
| VI | 1,1-dimethoxy ethane |
| VII | 1,1-dimethoxy-n-butane |
| VIII | 1,1-diethoxy-n-butane |
| IX | 2,2-dimethoxy-n-butane |
| X | 2,2-diethoxy-n-butane |
| XI | ethyl orthoformate |

Results comparable to the above may be obtained if the hydrocarbon component is:

TABLE

| EXAMPLE | HYDROCARBON |
|---|---|
| X | light cycle gas |
| XI | light gas oil |
| XII | heavy gas oil |

Although this invention has been illustrated by reference to specific embodiments, it will be apparent to those skilled in the art that various changes and modifications may be made which clearly fall within the scope of this invention.

I claim:

1. A novel hydrocarbon fuel composition heavier than gasoline comprising a hydrocarbon fuel heavier than gasoline; a water-miscible alcohol, ethanol or methanol which is substantially immiscible with said fuel; and as a cosolvent an orthoester.

2. The method of extending a hydrocarbon fuel heavier than gasoline which comprises mixing (i) a hydrocarbon fuel heavier than gasoline, (ii) a water-miscible alcohol which is substantially immiscible with said fuel, and (iii) ethyl orthoformate thereby forming a single phase extended hydrocarbon fuel composition heavier than gasoline; and recovering said single phase extended hydrocarbon fuel composition heavier than gasoline.

* * * * *